US005970827A

United States Patent [19]

Lin

[11] Patent Number: 5,970,827

[45] Date of Patent: Oct. 26, 1999

[54] ADJUSTABLE PLIER DEVICE

[76] Inventor: Chien-Jung Lin, No. 9, Fong Show Road, T ah Show Village, Shen Kang Hsiang, Taichung Hsien, Taiwan

[21] Appl. No.: 09/035,799

[22] Filed: Mar. 6, 1998

[51] Int. Cl.[6] ..... B25B 7/04

[52] U.S. Cl. ..... 81/409; 81/409

[58] Field of Search ..... 81/409

[56] References Cited

U.S. PATENT DOCUMENTS 5,020,399 6/1991 Annis et al. ..... 81/358

5,060,543 10/1991 Warheit ..... 81/409

*Primary Examiner*—David A. Scherbel

*Assistant Examiner*—Shantese McDonald

*Attorney, Agent, or Firm*—Charles E. Baxley, Esq.

[57] ABSTRACT

A plier device includes a pair of beams each having a handle and a jaw. One of the beam has a channel formed in the middle portion, the other beam includes a shaft slidably engaged in the channel for allowing the jaws to be widely opened and includes one or more pivotally coupled wheels engaged between the beams for allowing the jaws to be easily and quickly moved toward each other to engage with the object to be clamped. A lever is pivotally coupled to the shaft and has a number of teeth for engaging with a projection of the beam and for allowing the jaws of the beams to be solidly forced toward each other in order to solidly clamp the object.

6 Claims, 5 Drawing Sheets

ADJUSTABLE PLIER DEVICE

BACKGROUND OF THE INVENTION

1. Field of the Invention

The present invention relates to a plier device, and more particularly to an adjustable plier device.

2. Description of the Prior Art

Typical plier devices comprise a pair of beams pivotally coupled together at a middle portion by a pivot shaft for allowing the beams to be rotated about the pivot shaft. The beams each includes a handle formed on one end and each includes a jaw formed on the other end for allowing the jaws to be moved toward each other and to be moved away from each other by the handles. Normally, the jaws may not be widely opened such that the jaws may be used for engaging with smaller pipes or objects. One type of the plier devices comprise a latch provided in one of the beams and comprise a number of teeth provided in the other beam for engaging with the latch and for allowing the jaws to be easily and widely opened for engaging with larger objects. However, the latch may not be easily controlled and actuated to engage with the teeth such that the typical plier devices may not be easily operated.

The present invention has arisen to mitigate and/or obviate the afore-described disadvantages of the conventional plier devices.

SUMMARY OF THE INVENTION

The primary objective of the present invention is to provide a plier device having two jaws that may be widely opened and that may be easily and quickly moved toward each other for engaging with larger objects.

In accordance with one aspect of the invention, there is provided a plier device comprising a pair of beams each including a first end having a handle and each including a second end having a jaw, the beams each including a middle portion, a first of the beams including a channel formed in the middle portion of the first beam, a second of the beams including a shaft rotatably secured to the middle portion of the second beam and slidably engaged with the channel of the first beam for allowing the shaft to be moved along the channel and to be moved from a first end of the channel to a second end of the channel, and for allowing the jaw of the second beam to be moved toward and away from the jaw of the first beam, the second beam including a sliding means for sliding relative to the first beam. The shaft is allowed to be moved along the channel and the jaw of the second beam is allowed to be moved toward the jaw of the first beam when the sliding means of the second beam is engaged with the first beam and when the handles are moved toward each other.

The sliding means of the second beam includes at least one wheel rotatably secured to the second beam and slidably engaged with the first beam for allowing the shaft to be quickly moved along the channel when the at least one wheel is forced to move along the first beam toward the jaw of the first beam. The second beam includes a follower pivotally coupled to the second beam at a pivot axle, the at least one wheel is pivotally coupled to the follower at a pin. A biasing means is further provided for biasing the at least one wheel to engage with the first beam.

The first beam includes a projection provided in the middle portion of the first beam, the plier device further includes a lever having a first end pivotally coupled to the shaft for allowing the first end of the lever to be moved along the channel together with the shaft, the lever includes a plurality of teeth for engaging with the projection of the first beam and for allowing the jaw of the second beam to be solidly forced toward the jaw of the first beam. A forcing means is further provided for forcing the shaft and the first end of the lever to move toward the first end of the channel. The middle portion of the second beam includes a hole, the first end of the lever is rotatably engaged in the hole and pivotally coupled to the shaft.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
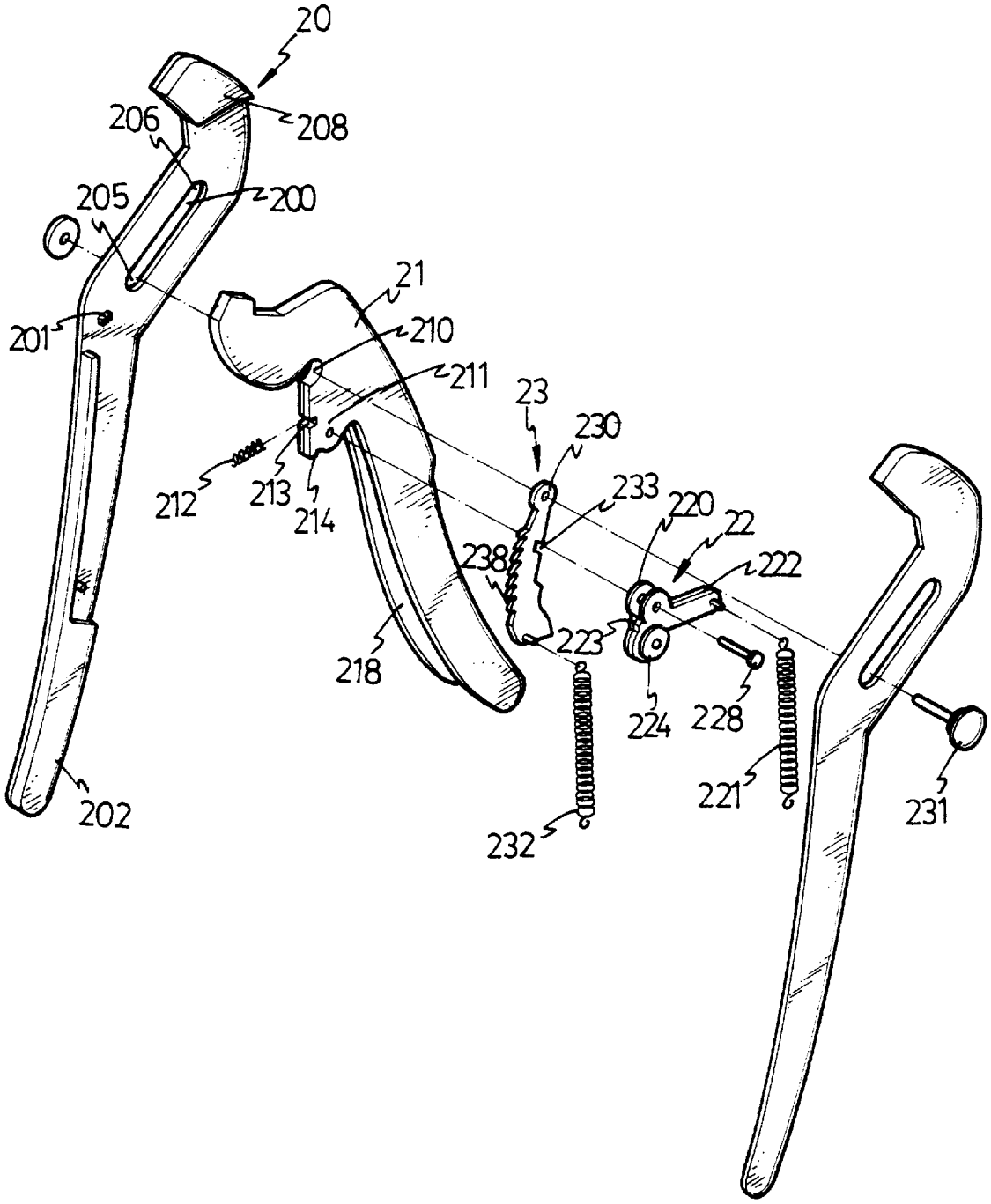
FIG. 1 is an exploded view of a plier device in accordance with the present invention.
Figure 2:
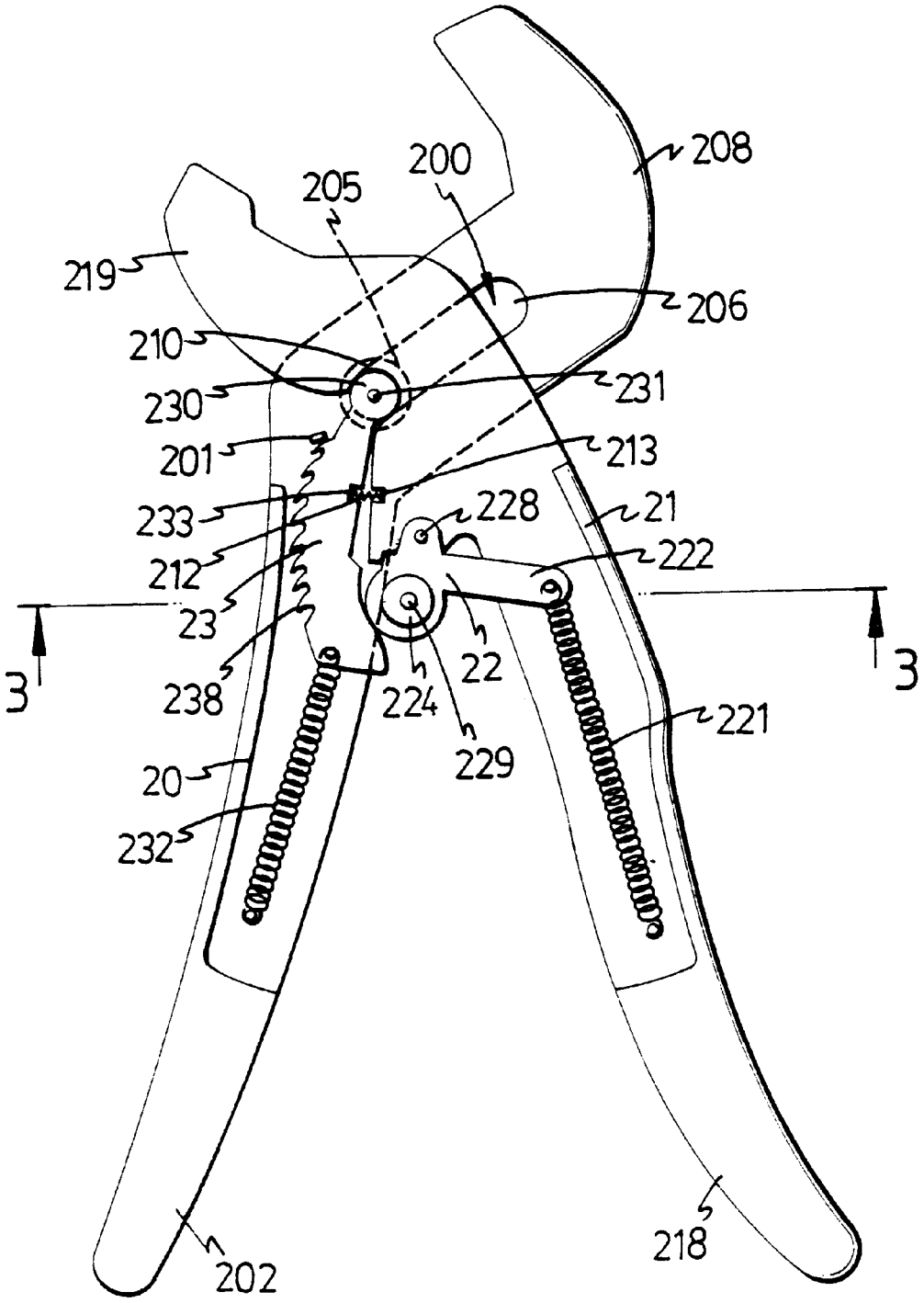
FIG. 2 is a plan view of the plier device.
Figure 3:
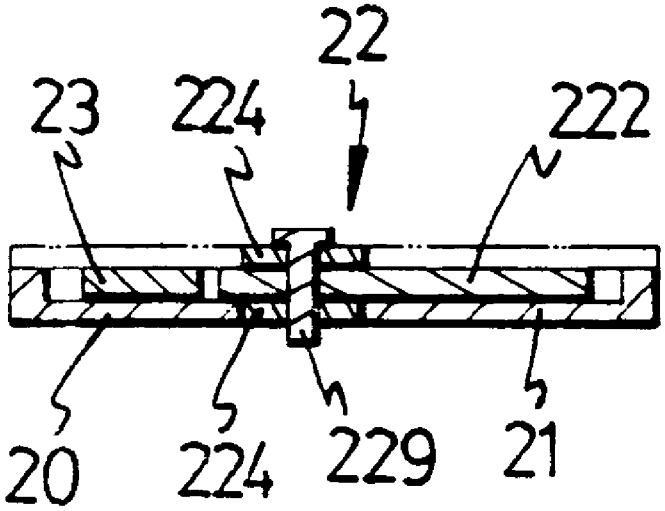
FIG. 3 is a cross sectional view taken along lines 3—3 of FIG. 2.

Referring to the drawings, and initially to FIGS. 1–3, a plier device in accordance with the present invention comprises a pair of beams 20, 21 each including a handle 202, 218 formed on one end and each including a jaw 208, 219 formed on the other end. It is preferable that the beams 20, 21 each includes two half members secured together by such as fasteners or by welding processes. The beam 20 includes a channel 200 and a projection 201 provided in the middle portion. The channel 200 includes one end 206 located closer to the jaw 208 and the other end 205 spaced away from the jaw 208. The other beam 21 includes a hole 210 and a bulge 211 provided in the middle portion. The bulge 211 includes a depression 213 for engaging with one end of a spring 212 and includes a stop 214 formed in the bottom corner.

A follower 22 has an ear 220 pivotally coupled to the bulge 211 at a pivot axke 228 for allowing the follower 22 to be rotated about the pivot axle 228. The follower 22 includes one or two wheels 224 rotatably secured to the follower 22 at a pin 229 and includes a shoulder 223 for engaging with the stop 214 of the beam 21 and for limiting the rotational movement of the follower 22 relative to the beam 21. The follower 22 includes one end 222, opposite to the wheels 224, coupled to the beam 21 by a spring 221 which may bias the wheels 224 to engage with the middle portion of the beam 20 for allowing the wheels 224 and thus the follower 22 and the beam 21 to be moved upward and downward along the middle portion of the beam 20 by the engagement of the wheels 224 with the beam 20 (FIGS. 2–5).

A lever 23 includes one end 230 rotatably engaged in the hole 210 of the beam 21 for allowing the lever 23 to be rotated relative to the beam 21 about the one end 230 of the lever 23. The lever 23 includes a recess 233 for engaging with the other end of the spring 212 and includes a number of teeth 238 for engaging with the projection 201 of the beam 20. A shaft 231 is engaged through the one end 230 of the lever 23 and slidably engaged in the channel 200 of the beam 20 for allowing the shaft 231 and thus the lever 23 and the beam 21 to be moved relative to the beam 20 along the channel 200. A spring 232 couples the lower end of the lever 23 to the beam 20 for moving the shaft 231 downward toward the lower end 205 of the channel 200.

Figure 4:
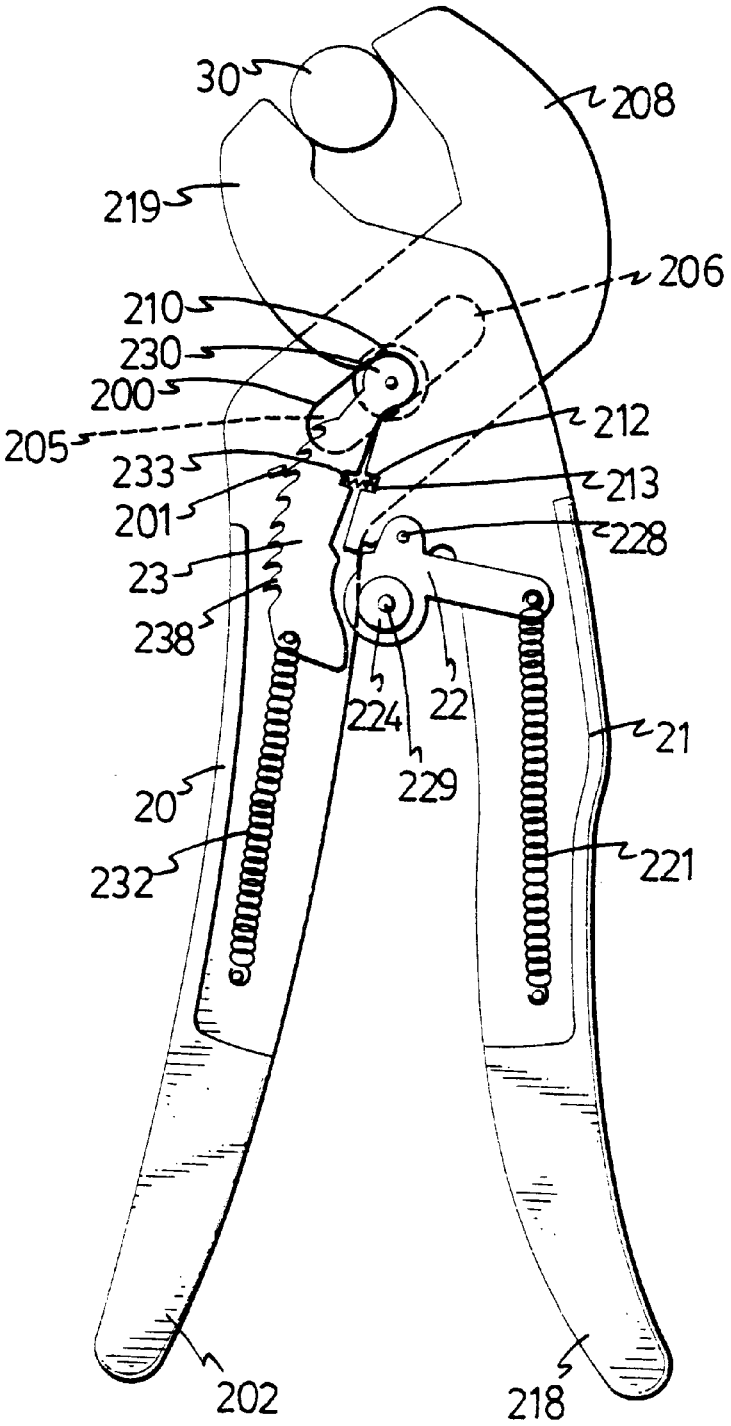
FIGS. 4 and 5 are plan views illustrating the operation of the plier device.
Figure 5:
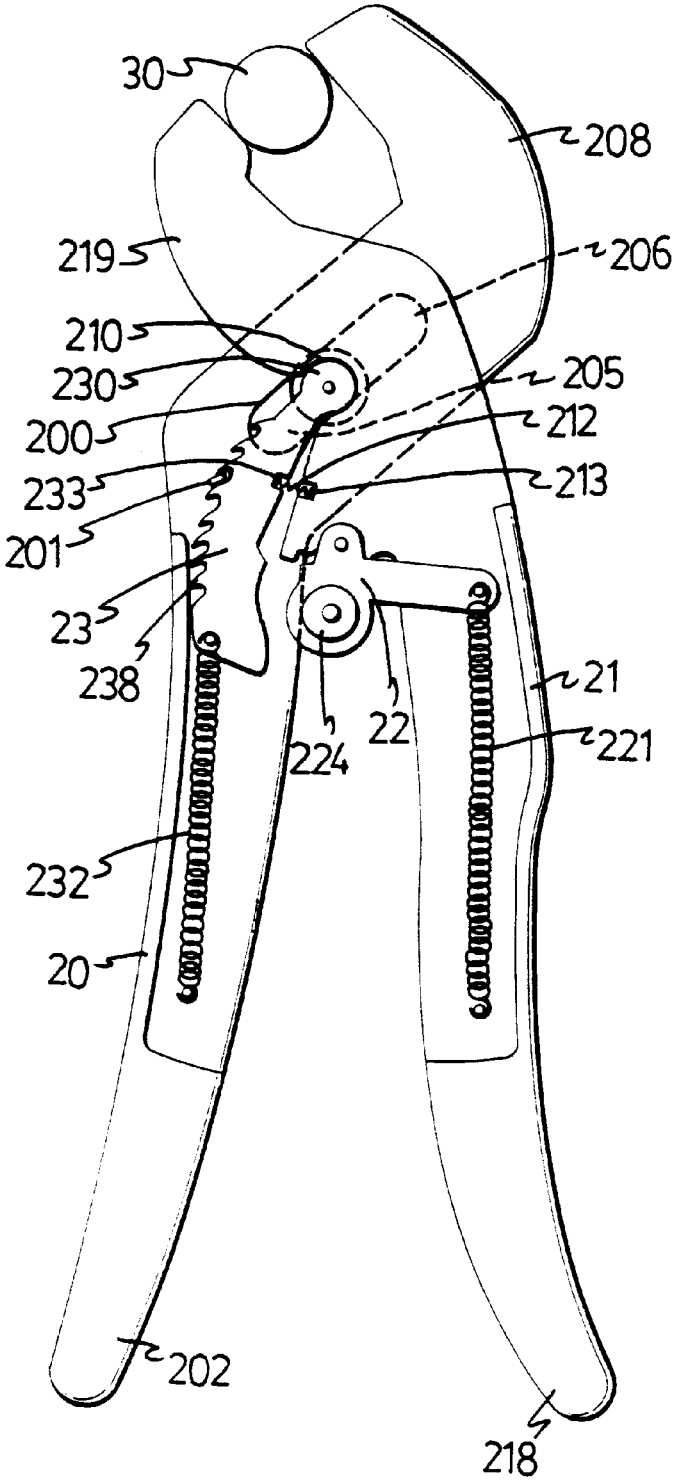

In operation, as shown in FIG. 2, when no force is applied to the handles 202, 218, the spring 232 may pull and force the shaft 231 to move toward the lower end 205 of the channel 200 for allowing the jaws 208, 219 to be widely opened. As shown in FIG. 4, when the handles 202, 218 are moved toward each other, the follower 22 may slightly be forced to rotate about the axle 228 against the spring 221 and the wheels 224 may be forced to move upward along the middle portion of the beam 20 and the shaft 231 may also be forced to move toward the other end 206 of the channel 200 until the jaw 219 is engaged with the object 30 to be clamped, such that the jaw 219 may be quickly moved toward the other jaw 208. At this moment, the teeth 238 of the lever 23 will not be forced to engage with the projection 201. When the jaws 208, 219 are engaged with the object 30 and when the handles 202, 218 are further be moved toward each other, as shown in FIG. 5, the jaws 208, 219 may no longer be moved toward each other such that the shaft 231 and the lever 23 may be moved slightly backward toward the lower end 205 of the channel 200 until the teeth 238 is engaged with the projection 201. The shaft 231 and the lever 23 may thus be solidly secured to the beam 20. The beams 20, 21 may thus be solidly secured together and may thus be rotated relative to each other about the shaft 231 only. The object 30 may thus be further solidly secured between the jaws 208, 219 when the handles 202, 218 are further forced toward each other. The jaws 208, 219 may be easily and quickly separated from each other by the spring 232 when the handles 202, 218 are released.

It is to be noted that the engagement of the wheels 224 with the beam 20 is provided for allowing the jaw 219 of the beam 21 to be smoothly and quickly moved toward the jaw 208 of the beam 20 before the jaw 219 is engaged with the object 30. Without the wheels 224, the jaws 208, 219 may also be easily and quickly moved toward each other.

Accordingly, the plier device in accordance with the present invention includes two jaws that may be widely opened and may be easily and quickly moved toward each other for engaging with larger objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A plier device comprising:

a pair of beams each including a first end having a handle and each including a second end having a jaw, said beams each including a middle portion, a first of said beams including a channel formed in said middle portion of said first beam, a second of said beams including a shaft rotatably secured to said middle portion of said second beam and slidably engaged with said channel of said first beam for allowing said shaft to be moved along said channel and to be moved from a first end of said channel to a second end of said channel, and for allowing said jaw of said second beam to be moved toward and away from said jaw of said first beam, said second beam including a sliding means for sliding relative to said first beam, said shaft being allowed to be moved along said channel and said jaw of said second beam being allowed to be moved toward said jaw of said first beam when said sliding means of said second beam is engaged with said first beam and when said handles are moved toward each other, and said sliding means of said second beam including at least one wheel rotatably secured to said second beam and slidably engaged with said first beam for allowing said shaft to be quickly moved along said channel when said at least one wheel is forced to move along said first beam toward said jaw of said first beam.

2. The plier device according to claim 1, wherein said second beam includes a follower pivotally coupled to said second beam at a pivot axle, said at least one wheel is pivotally coupled to said follower at a pin.

3. The plier device according to claim 2 further comprising means for biasing said at least one wheel to engage with said first beam.

4. A plier device comprising:

a pair of beams each including a first end having a handle and each including a second end having a jaw, said beams each including a middle portion, a first of said beams including a channel formed in said middle portion of said first beam, a second of said beams including a shaft rotatably secured to said middle portion of said second beam and slidably engaged with said channel of said first beam for allowing said shaft to be moved along said channel and to be moved from a first end of said channel to a second end of said channel, and for allowing said jaw of said second beam to be moved toward and away from said jaw of said first beam, said second beam including a sliding means for sliding relative to said first beam, said shaft being allowed to be moved along said channel and said jaw of said second beam being allowed to be moved toward said jaw of said first beam when said sliding means of said second beam is engaged with said first beam and when said handles are moved toward each other, and said first beam including a projection provided in said middle portion of said first beam, said plier device further including a lever having a first end pivotally coupled to said shaft for allowing said first end of said lever to be moved along said channel together with said shaft, said lever including a plurality of teeth for engaging with said projection of said first beam and for allowing said jaw of said second beam to be solidly forced toward said jaw of said first beam.

5. The plier device according to claim 4 further comprising means for forcing said shaft and said first end of said lever to move toward said first end of said channel.

6. The plier device according to claim 4, wherein said middle portion of said second beam includes a hole, said first end of said lever is rotatably engaged in said hole and pivotally coupled to said shaft.

* * * * *